US009262902B2

(12) United States Patent
Costa

(10) Patent No.: US 9,262,902 B2
(45) Date of Patent: Feb. 16, 2016

(54) APPARATUS AND METHOD FOR TAGGING A PERPETRATOR

(71) Applicant: John Costa, Saugerties, NY (US)

(72) Inventor: John Costa, Saugerties, NY (US)

( * ) Notice: Subject to any disclaimer, the term of this patent is extended or adjusted under 35 U.S.C. 154(b) by 39 days.

(21) Appl. No.: 13/936,842

(22) Filed: Jul. 8, 2013

(65) Prior Publication Data

US 2014/0352818 A1 Dec. 4, 2014

Related U.S. Application Data

(60) Provisional application No. 61/828,098, filed on May 28, 2013.

(51) Int. Cl.
*G08B 15/02* (2006.01)

(52) U.S. Cl.
CPC ..... *G08B 15/02* (2013.01); *Y10T 137/8376* (2015.04)

(58) Field of Classification Search
CPC ..... E05G 1/12; E05G 1/10; E05G 1/04; E05G 5/00; G08B 15/00; G08B 15/02
USPC ..... 109/20, 21, 25, 29, 31, 32, 38
See application file for complete search history.

(56) References Cited

U.S. PATENT DOCUMENTS

| | | | | | |
|---|---|---|---|---|---|
| 1,477,701 | A * | 12/1923 | Green | 251/74 |
| 3,230,912 | A * | 1/1966 | Hohmann | 109/20 |
| 4,068,780 | A * | 1/1978 | Fegley | 222/5 |
| 4,867,076 | A * | 9/1989 | Marcone | 109/20 |
| 4,996,521 | A * | 2/1991 | Hollow | 340/691.7 |
| 5,402,000 | A * | 3/1995 | Owens, II | 340/545.1 |
| 5,598,142 | A * | 1/1997 | Winner, Jr. | 340/438 |
| 5,655,461 | A * | 8/1997 | Gilbert | 109/20 |
| 5,881,915 | A * | 3/1999 | Smrz | 222/78 |
| 7,488,954 | B2 * | 2/2009 | Ross et al. | 250/458.1 |
| 7,690,540 | B1 * | 4/2010 | Owens | 222/642 |
| 7,857,198 | B2 * | 12/2010 | Bell | 232/1 D |
| 2006/0049931 | A1 * | 3/2006 | Sugimura | 340/500 |
| 2008/0152229 | A1 * | 6/2008 | Wang et al. | 382/192 |
| 2010/0065463 | A1 * | 3/2010 | Taylor | 206/524.1 |
| 2010/0128123 | A1 * | 5/2010 | DiPoala | 348/143 |
| 2014/0106357 | A1 * | 4/2014 | Berrada et al. | 435/6.12 |
| 2014/0158027 | A1 * | 6/2014 | Bolden | 109/29 |
| 2014/0306818 | A1 * | 10/2014 | Batchelder et al. | 340/501 |
| 2014/0352818 | A1 * | 12/2014 | Costa | 137/560 |
| 2014/0353283 | A1 * | 12/2014 | Kahramangil et al. | 219/68 |

* cited by examiner

*Primary Examiner* — Suzanne Barrett
(74) *Attorney, Agent, or Firm* — Tech Valley Patent, LLC; John Pietrangelo

(57) ABSTRACT

Apparatus and methods for tagging, or otherwise marking, a perpetrator or suspected perpetrator are provided. The apparatus includes a marker delivery device configured to mark the perpetrator, for example, with a canine scent or fluorescent marker; and a trigger configured to actuate the marker delivery device, for example, a button or switch. The marker delivery device may deliver a fluid or a solid to the clothes or accessories of a perpetrator when activated. The apparatus may also include a sensor adapted to detect the presence of the perpetrator, for example, an optical or mechanical sensor. The sensor may be adapted to detect the presence of the perpetrator in a target area of the marker delivery device. Methods of tagging are also disclosed. Aspects of the invention are uniquely adapted for convenience store or gas station security, but can also be applied in residential and office environments, among others.

20 Claims, 4 Drawing Sheets

APPARATUS AND METHOD FOR TAGGING A PERPETRATOR

CROSS-REFERENCE TO RELATED APPLICATION

This application claims priority from U.S. Provisional Patent Application 61/828,098 filed on May 28, 2013, the disclosure of which is included by reference herein in its entirety.

BACKGROUND OF THE INVENTION

1. Field of the Invention

The present invention relates, generally, to apparatus and methods for tagging a perpetrator, for example, with a detectable marker. Particularly, the present invention relates to apparatus and methods for covertly tagging a perpetrator while the perpetrator is exiting a store with a scent or dye that can be detected by law enforcement personnel.

2. Description of Related Art

Small commercial establishments, for example, convenience stores, liquor stores, and gas stations, are often the targets of thieves and delinquents due to their availability and since they are typically employed by single employees, especially at off-peak hours, such as, in the late evening. Though attacks or robberies of such establishments are common, statistics strongly indicate that the perpetrators are often not apprehended nor are potential suspects even identified.

The reasons for the lack of success in apprehending perpetrators and in reducing the number of incidents are myriad and unclear. However, a clear need exists to discourage perpetrators while increasing the rate at which perpetrators are apprehended and brought to justice. Aspects of the present invention provide apparatus and methods addressing this well-recognized need.

SUMMARY OF ASPECTS OF THE INVENTION

Aspects of the present invention address this well-recognized need by providing apparatus and methods for tagging perpetrators, for example, as they leave a commercial establishment, such as, a convenience store, wherein the perpetrator can be later identified by detecting the tag, for example, a scent.

One embodiment of the present invention is an apparatus for tagging a perpetrator, the apparatus comprising or including a marker delivery device configured to mark the perpetrator; and a trigger configured to actuate the marker delivery device. The marker delivery device may be a fluid delivery device, for example, a sprayer, and a solid delivery device, for example, a projectile emitter. In one aspect, the marker is a scent, for example, a canine-detectable scent. The apparatus may also include a sensor adapted to detect a presence of the perpetrator.

Another embodiment of the invention is a method for tagging a perpetrator with a marker, the method comprising or including determining the presence of a perpetrator; and contacting the perpetrator with the marker. The method may further include sensing a presence of the perpetrator in a target area before contacting the perpetrator with the marker in the target area. In one aspect, contacting the perpetrator may be practiced by activating a marker delivery device. In one aspect, the method further comprises identifying the perpetrator by detecting the marker on the perpetrator.

A further embodiment of the invention is an apparatus for tagging a perpetrator, the apparatus comprising or including a canine scent delivery device; a sensor adapted to sense the presence of the perpetrator in a target area of a canine scent delivery device; and a trigger configured to activate at least one of the canine scent delivery device and the sensor; wherein when the trigger is actuated and at least one of the canine scent delivery device and the sensor are activated, when a perpetrator in the target area is detected by the sensor, canine scent is sprayed on the perpetrator by the canine scent delivery device. In one aspect, the apparatus may further include a fluorescent marker delivery device. In another aspect, the canine scent delivery device is positioned in a vicinity of a door or in a door.

Details of these aspects of the invention, as well as further aspects of the invention, will become more readily apparent upon review of the following drawings and the accompanying claims.

BRIEF DESCRIPTION OF THE FIGURES

The subject matter that is regarded as the invention is particularly pointed out and distinctly recited in the claims at the conclusion of this specification. The foregoing and other objects, features, and advantages of the invention will be readily understood from the following detailed description of aspects of the invention taken in conjunction with the accompanying drawings, in which:

DETAILED DESCRIPTION OF FIGURES

Figure 1:
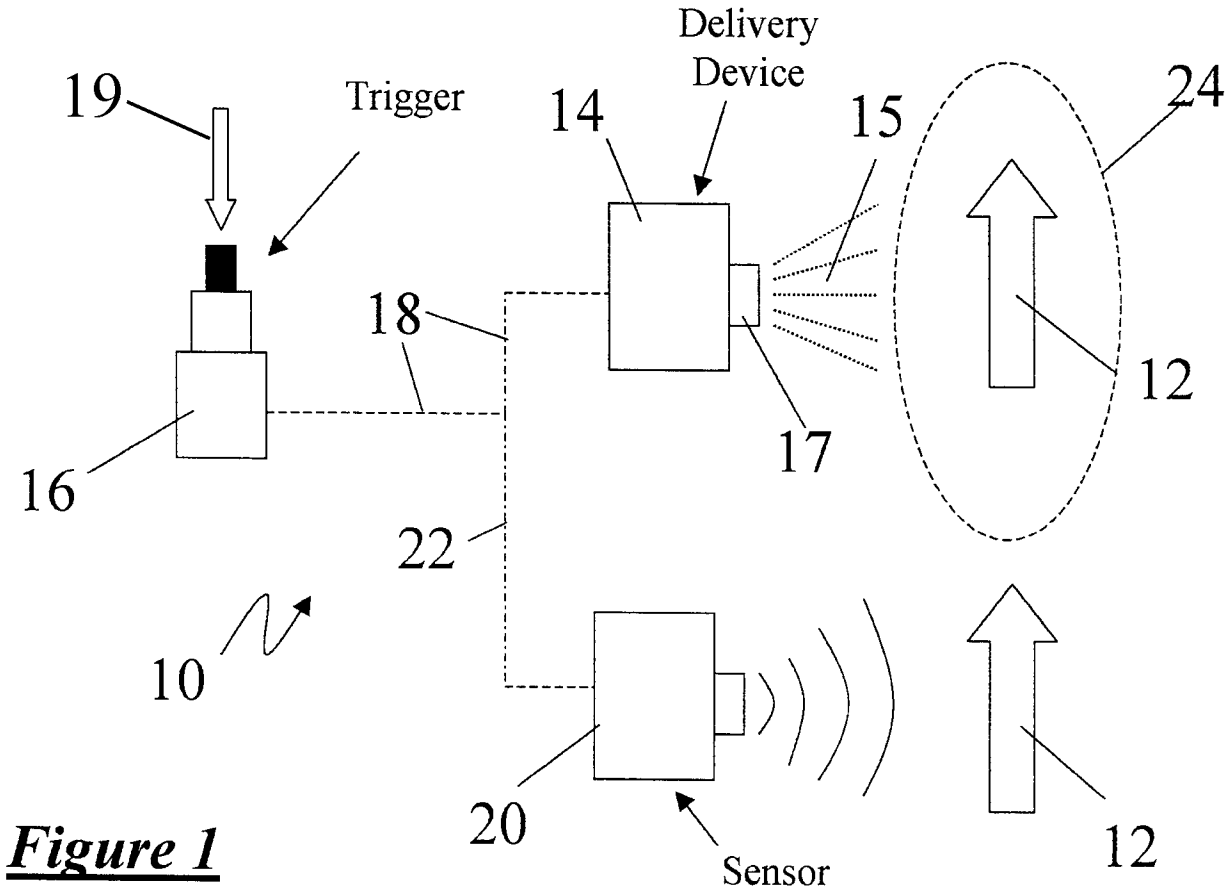
FIG. 1 is a schematic diagram of an apparatus for tagging a perpetrator according to one aspect of the invention.

The details and scope of the embodiments and aspects of the present invention can best be understood upon review of the attached figures and their following descriptions. FIG. 1 is a schematic diagram of an apparatus 10 for tagging, marking, labeling, or otherwise placing an identifiable indicator on a perpetrator according to one aspect of the invention. In the diagram shown in FIG. 1 a perpetrator 12, for example, a thief, a robber, a burglar, a shoplifter, a bandit, a mugger, an assailant, an aggressor, a criminal, a crook, among other wrongdoers or suspected wrongdoers, and the direction the perpetrator 12 is moving is indicated by arrow 12. Apparatus 10 includes a marker delivery device 14, for example, a sprayer, configured to mark the perpetrator 12, and a trigger 16, for example, a switch, configured to actuate the marker delivery device 14. Marker delivery device 14 comprises a device that emits a marker 15, for example, a solid, a liquid, a gas, or a combination thereof, that contacts perpetrator 12 and that is detectable and/or identifiable at a later time, for example, after the suspected perpetrator 12 is apprehended. According to aspects of the invention, when an operator, for example, a convenience store attendant, a sales clerk, a cashier, a bank teller, a storekeeper, a shopkeeper, a retailer, a proprietor, a business owner, a home owner, an office worker, a security guard, or a police officer, among others, identifies a perpetrator 12 or even a potential perpetrator, trigger 16 is actuated, for example, manually actuated, whereby delivery device 14 emits marker 15, for example, in the form of a spray or mist.

According to aspects of the invention, marker delivery device 14 may comprise a fluid delivery device, such, as a liquid delivery device or a gas delivery device, or a solid delivery device, wherein the solid, liquid, or gas delivered may be detectable at a later time. In one aspect, marker delivery device 14 emits a gas, for example, a visible or a substantially invisible gas, for instance, neon gas or water vapor, that can attach to, for example, condense on, perpetrator 12 for later detection, for example, on the clothes or on an accessory worn or carried by perpetrator 12, and can then be detected at a later time. In another aspect, marker delivery device 14 may emit a liquid, for example, a visible or a substantially invisible liquid, for example, a paint or a dye, that contacts perpetrator 14, for example, contacts the clothes or an accessory worn or carried by perpetrator 12, and can then be detected at a later time. In another aspect, marker delivery device 14 may emit a solid, for example, a visible or a substantially invisible solid, for example, chalk or a GPS microchip or another detectable electronic device, such, as traceable micro emitter or micro chip, that contacts or attaches to perpetrator 14, for example, contacts the clothes or an accessory worn or carried by perpetrator 12 and can then be detected at a later time. In one aspect, one or more of these markers may be delivered by delivery device 14. In one aspect, the marker may be directed to a lower extremity of the perpetrator 12, for example, on a shoe or on a pant cuff. According to aspects of the invention, "at a later time" may be at least 5 minutes later than when delivered, but is typically, at least one hour later, and may be, days, weeks, months, or even years later, depending upon the marker used.

In one aspect of the invention, marker 15 may comprise a liquid scent, for example, a scent that can be detected by a tracking animal, such as, a canine, that is, a dog. For example, the liquid scent may be a pheromone or pheromone-type scent, for example, as provided by commercial laboratory. In one aspect the marker may be a fluorescent marker, for example, a fluorescent dye, such as, an A/C fluorescent dye, or its equivalent.

Delivery device 14 may be any conventional delivery device capable of emitting a solid, liquid, or gas marker and operate under the direction of trigger 16, for example, via electrical connection 18, such, as a conventional communications cable or wire. For example, in one aspect, delivery device 14 may include a nozzle 17 operatively connected to a supply of marker 15, for example, a pressurized supply (not shown) of marker 15. In one aspect, delivery device 14 may include one or more valves (not shown) configured to operate under the influence of trigger 16 and operatively connected to the pressurized supply of marker 15 whereby a pressurized fluid (that is, a liquid and/or gas) can be emitted from nozzle 17 when trigger 16 is actuated.

Trigger 16 may be any electrical device configured to energize or actuate delivery device 14 when activated, as indicated by arrow 19. For example, trigger 16 may be operatively connected to a power supply (not shown) and, when activated, trigger 16 directs electric power to delivery device 14 to emit marker 15. Trigger 16 may be any type of conventional switch or activator, such as, a toggle switch. Trigger 16 may be manually activated (including by foot), sound activated, or motion activated, among other means of activation. Electrical connection 18 between trigger 16 and delivery device 14 may be hardwired or wireless, for example, a Bluetooth wireless connection, among other wireless protocols.

In one aspect, trigger 16 may be a trigger adapted to be activated by a noise, for example, a noise having a sound level of about 100 decibels (dB) or above or about 150 dB or above, for instance, a trigger adapted to be activated by the sound of a gunshot.

According to one aspect of the invention, apparatus 10 may also include a sensor 20 configured to detect a presence of perpetrator 12. Sensor 12 may be an optical sensor or a motion sensor, among others, adapted to detect the presence of or passage of perpetrator 12. In one aspect, sensor 20 may directly detect the presence or proximity of perpetrator 12 to sensor 20 or delivery device 14. In another aspect, sensor 20 may indirectly detect the presence or proximity of perpetrator 12 to sensor 20 or delivery device 14, for example, sensor 20 may detect the movement or displacement of a structure handled by perpetrator 12, for example, the opening of a door through which perpetrator 12 passes. Sensor 20 may be operatively connected to delivery device 14 and to trigger 16, for example, via electrical connections 18 and 22.

According to one aspect of the invention, when trigger 16 is actuated, both sensor 20 and delivery device 14 are activated, but delivery device 14 does not emit marker 15 until sensor 20 detects the presence or passage of perpetrator 12, for example, the presence or passage of perpetrator 12 in the target area 24 of delivery device 14. The target area 24 of device 14 is typically the area or volume into which delivery device 14 can deliver marker 15.

Though not shown in FIG. 1, trigger 16 and marker deliver device 14 may be proximate each other or remote from each other. For example, marker delivery device 14 may be within 3 feet of trigger 16 or within 500 feet of trigger 16. In one aspect, marker delivery device 14 may be in visible distance from trigger 16, that is, within visible distance of an operator actuating trigger 16 whereby the operator can actuate trigger 16 when perpetrator 12 is within target area 24. However, when sensor 20 is provided, marker delivery device 14 need not be within visible distance of trigger 16 since sensor 20 may determine when perpetrator 12 is within target area 24 before delivery device 14 emits marker 15.

Figure 2:
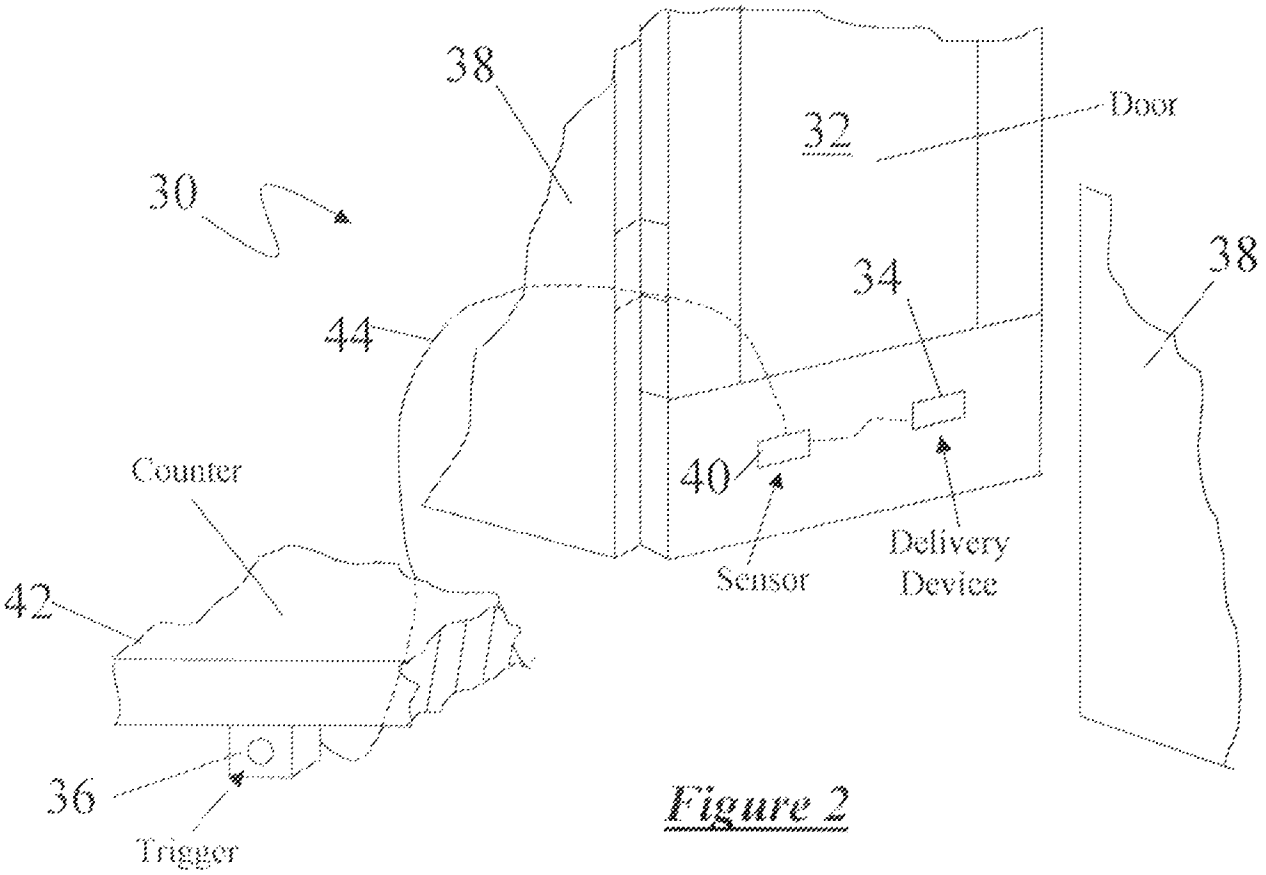
FIG. 2 is a schematic diagram of another apparatus for tagging a perpetrator according to another aspect of the invention.

FIG. 2 is a schematic diagram of another apparatus 30 for tagging a perpetrator (not shown) according to another aspect of the invention. Similar to apparatus 10 shown in FIG. 1, apparatus 30 includes a marker delivery device 34 configured to mark the perpetrator (not shown) and a trigger 36 configured to actuate the marker delivery device 34. Apparatus 30 may also include a sensor 40 configured to detect a presence of the perpetrator. Marker delivery device 34, trigger 36, and sensor 40 may have all the attributes of marker delivery device 14, trigger 36, and sensor 20, respectively, described above with respect to FIG. 1. For example, marker device 34 may emit a marker, for example, a solid, a liquid, a gas, or a combination thereof, that contacts the perpetrator and that is detectable, for example, by law enforcement at a later time.

As shown in FIG. 2, apparatus 30 may be configured into a door 32, or other means of egress or ingress, of a building or structure 38, for example, a door of a convenience store, a liquor store, a pawn shop, a restaurant, a bank, a gas station, an office, or another commercial, or residential structure, such as, a home or an apartment. As shown in FIG. 2, in one aspect, marker delivery device 34 and sensor 40 may be positioned, for example, mounted, in the lower section of door 32 to be the least conspicuous to a perpetrator, though marker delivery device 34 and sensor 40 may be positioned anywhere in door 32 or anywhere in structure 38, for example, adjacent to door 32. In one aspect, at least one of marker delivery device 34 and sensor 40 may be positioned anywhere inside or outside of structure 38 and positioned where a perpetrator can be expected to pass. For example, at least one of marker delivery device 34 and sensor 40 may be positioned outside of structure 38, for example, in a post, stanchion, or housing (not shown) positioned inside, outside, or adjacent to door 32. In one aspect, the post, stanchion, and/or housing may be suitably camouflaged or concealed to minimize or prevent detection by passersby, that is, potential perpetrators or non-potential perpetrators.

A shown in FIG. 2, in one aspect, trigger 36 may be remotely positioned from delivery device 34, and, for example, substantially concealed from view. For example, trigger 36 may be positioned beneath a counter 42 or beneath or behind another structure, such as, a cash register, a safe, a drawer, a wall, or a barrier, among others. Again, trigger 36 may communicate with delivery device 34 and/or sensor 40 by means of one or more wires 44 or wirelessly, as is conventional.

Figure 3:
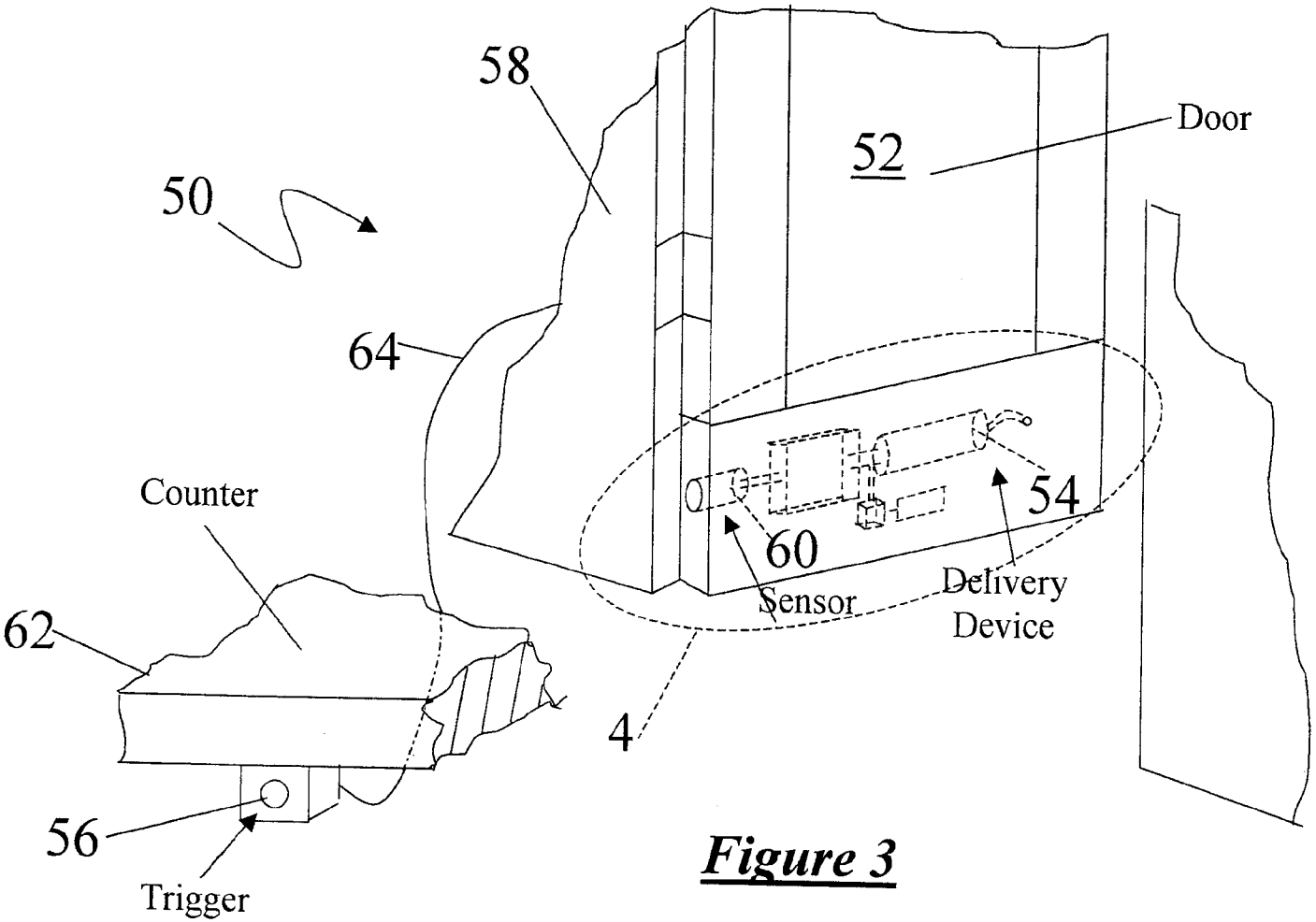
FIG. 3 is a schematic diagram of another apparatus for tagging a perpetrator according to another aspect of the invention.

FIG. 3 is a schematic illustration of another apparatus 50 for tagging a perpetrator (not shown) according to another aspect of the invention. Similar to apparatus 10 shown in FIG. 1 and to apparatus 30 shown in FIG. 2, apparatus 50 includes a marker delivery device 54 configured to mark the perpetrator (not shown) and a trigger 56 configured to actuate the marker delivery device 54. Apparatus 50 may also include a sensor 60 configured to detect a presence of the perpetrator. Marker delivery device 54, trigger 56, and sensor 60 may have all the attributes of marker delivery device 14, trigger 36, and sensor 20, respectively, described above with respect to FIG. 1. For example, market device 54 may emit a marker, for example, a solid, a liquid, a gas, or a combination thereof, that contacts perpetrator and that is detectable at a later time.

As shown in FIG. 3, apparatus 50 may be configured into a door 52, or other means of egress or ingress, of a building or structure 58. As shown in FIG. 2, though aspects of the invention may be housed in a housing (for example, in a box or container), in one aspect, marker delivery device 54 and sensor 60 may be mounted in the lower section of door 52, though marker delivery device 54 and sensor 60 may be positioned anywhere in door 52 or anywhere in structure 58, for example, adjacent to door 52, or anywhere inside or outside of structure 38, as described above with respect to apparatus 30 in FIG. 2.

Figure 4:
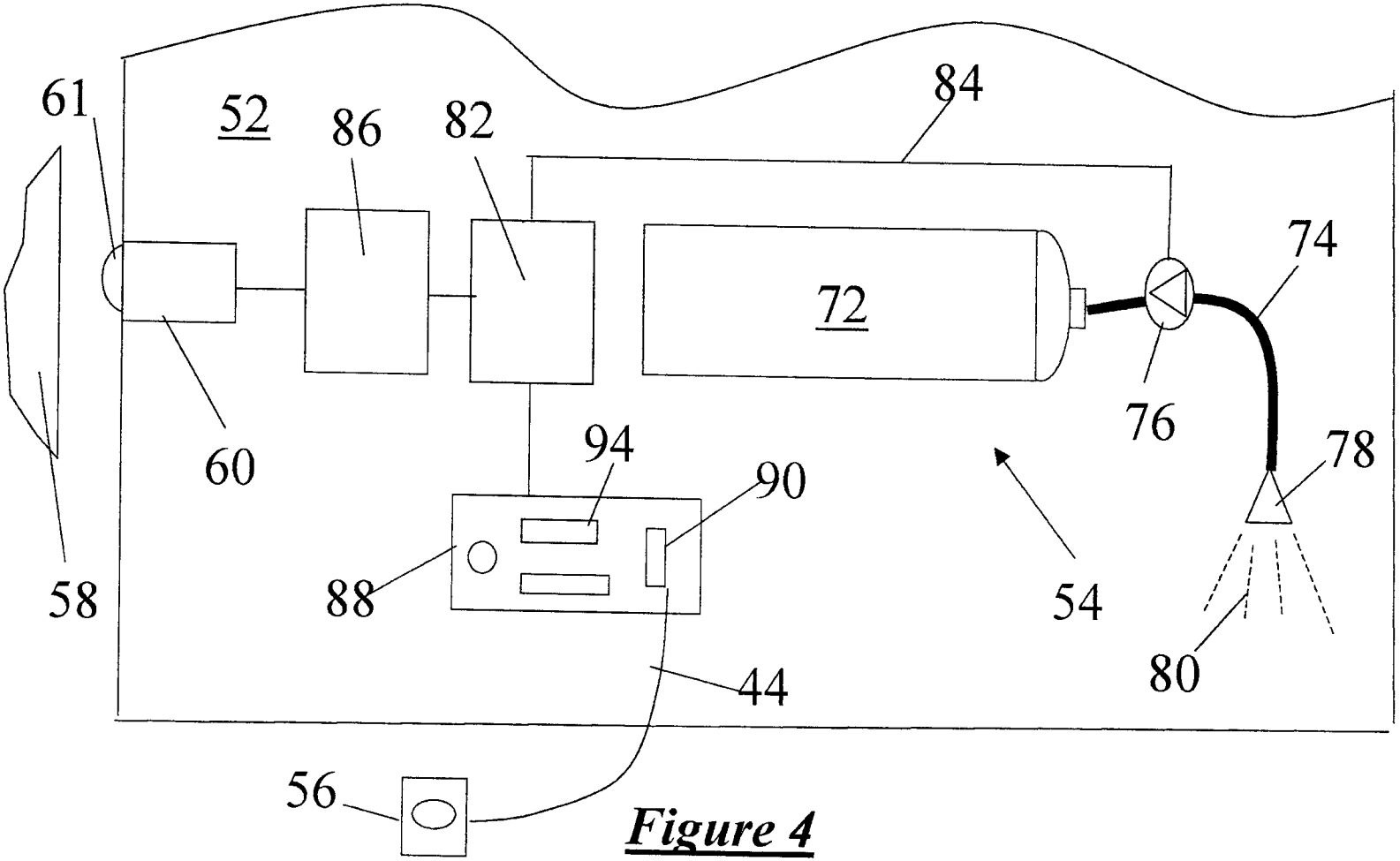
FIG. 4 is a detailed view of the apparatus shown in FIG. 3 identified as Detail 4 in FIG. 3.

FIG. 4 is a detailed schematic illustration of the components of apparatus 50 shown in FIG. 3 identified as Detail 4 in FIG. 3. Similar to apparatus 10 shown in FIG. 1 and apparatus 30 shown in FIG. 2, apparatus 50 includes a marker delivery device 54 configured to mark the perpetrator (not shown) and a trigger 56 (see FIG. 3) configured to actuate the marker delivery device 54. Apparatus 50 may also include a sensor 60 configured to detect a presence of the perpetrator. Marker delivery device 54, trigger 56, and sensor 60 may have all the attributes of marker delivery device 14, trigger 36, and sensor 20, respectively, described above with respect to FIG. 1. For example, marker device 54 may emit a marker, for example, a solid, a liquid, a gas, or a combination thereof, that contacts perpetrator and that is detectable at a later time.

As shown in FIG. 4, according to one aspect of the invention, marker delivery device 54 and sensor 60 may be housed in door 52, for example, in a lower panel of door 52. In one aspect, marker delivery device 54 may comprise multiple components, for example, a canister, supply, or tank 72 containing the marker, for example, a pressurized supply of canine detectable scent; a delivery line or hose 74 operatively connected to canister 72; a valve 76 adapted to control the flow of marker from canister 72; and a nozzle 78 mounted to delivery line 74 and adapted to emit marker 80 to a target area, as described herein, for example, as a mist or spray. Though in FIG. 4 nozzle 78 is shown directing marker 80 downward, it is to be understood that this illustration of the orientation of nozzle 78 in FIG. 4 is provide to facilitate illustration of an aspect of invention only. It should be understood that, though nozzle 78 may direct marker 80 in a downward direction, nozzle 78 typically directs marker 80 in a substantially horizontal, lateral, or upward direction, for example, in a direction substantially perpendicular to door 52 in order to contact the perpetrator (not shown) as intended, and disclosed herein.

According to aspects of the invention, the regulation or control of valve 76, and the flow of marker 80, may typically be automatedly regulated or controlled. For example, in one aspect, the operation of valve 76 may typically be automated and controlled by one or more mechanisms or controllers 82 via connection 84. Connection 84 may be an electrical connection (wired or wireless) or a mechanical connection; for example, connection 84 may transmit an electrical control signal to valve 76 or be a mechanical interface with valve 76, such as, a hydraulic line or pneumatic line or mechanical linkage.

Controller 82 may receive input from switch 60, for example, via switch interface 86, and/or from trigger 56, for example, via trigger interface 88. Switch 60 may be any conventional switch mechanism adapted to provide a signal to controller 82 when switch 60 is activated. In one aspect, switch 60 may be a spring-biased switch having a plunger 61 that is tripped, deflected, or otherwise activated when plunger 61 contacts or loses contact with mating structure 58, for example, the door jam of door 52. For example, when plunger 61 loses contact with door jam 58, this indicates that door 52 is being opened and the perpetrator is leaving, for example, the liquor store. According to one aspect, this indication from switch 60 that door 52 has been opened may be relayed to controller 82 via switch interface 86. Switch interface 86 may be mechanical or electrical. For example, switch interface 86 may comprise an electrical relay that receives a signal, either mechanical or electrical, from switch 60 and relays the signal to controller 82 indicting that door 52 has been opened. In another aspect, switch interface 86 may be a mechanical interface, for example, one or more cams, levers, linkages, motors, hydraulics, or pneumatics and the like, and combinations thereof, that receives a mechanical signal from switch 60 and relays the signal to controller 82, either mechanically or electrically. Switch 60 may also communicate directly with controller 82. Again, according to aspects of the invention, controller 82 may receive a signal from switch 60 that door 52 has been opened, for example, by the perpetrator.

In addition, according to aspects of the invention, controller 82 may receive a signal from trigger 56 indicating, for example, via trigger interface 88, that marker delivery device 54 may be activated, for example, since the trigger operator (for example, a convenience store attendant or bank teller) has identified a perpetrator or potential perpetrator that may be leaving, for example, the convenience store, through door 52. Trigger interface 88 may typically include a receiver 90, for example, a wired or wireless receiver, that receives a signal from trigger 56, for example, over wire 44. Again, wire 44 may represent wireless communication between trigger 56 and receiver 90. Trigger interface 88 may include conventional electrical or mechanical components adapted to receive, condition, and/or transmit a corresponding signal from trigger interface 88 to controller 82. For example, trigger interface 88 may include a transmitter 94 adapted to transmit a signal corresponding to a signal received from trigger 56 to controller 82. Trigger 56 may also communicate directly with controller 82. Again, according to aspects of the invention, controller 82 may receive a signal from trigger 56 via trigger interface 88 indicating that marker delivery device 54 can be activated and deliver marker 80, for example, when switch 60 indicates that door 52 has been opened, for example, by the perpetrator. The system shown in FIG. 4 may also include a power supply, for example, one or more batteries or solar cells or a connection to the electrical grid, illuminated indicators, and the like, but these are not shown in FIG. 4 to facilitate illustration of aspects of the invention.

The following example describes a typical operation of aspects of the invention with the assistance of the apparatus illustrated in FIGS. 3 and 4. According to one aspect of the invention, when a convenience store employee recognizes the presence of a perpetrator or a suspected perpetrator in the convenience store, the employee activates switch 56. Switch 56 either by wire 44 or wirelessly transmits a signal to marker delivery device 54, for example, via trigger interface 88 and controller 82, activating or "arming" marker delivery device 54 to emit marker 80. When the perpetrator exits the convenience store via door 52, the disengagement of switch 60 from door jam 58 causes switch 60 to transmit a signal to marker delivery device 54, for example, via switch interface 86 and controller 82, to activate marker delivery device 54 and deliver marker 80 by opening, for example, at least temporarily, valve 76. According aspects of the invention, marker 80 may be emitted for a time duration as short as 0.5 seconds, but is typically emitted for a duration of about 1 second to about 5 seconds, after which valve 76 is closed.

Typically, controller 82 activates marker delivery device 64 only when marker delivery device 54 has been activated, or otherwise prompted, by the actuation of trigger 56. For example, when controller 86 has received a signal from trigger 56, controller 82 will then await receipt of a signal from switch 60 before controller 82 activates or opens valve 76, for example, via electrical connecting 84. The opening of valve 76 allows marker 80, for example, a pressurized canine detectable scent marker 80 from cylinder 72, to pass through conduit 74 and be discharged from nozzle 78 and onto the perpetrator.

According to one aspect of the invention, marker 80 may be delivered covertly, that is, without the perpetrator's detection or knowledge. In another aspect, marker 80 may be delivered overtly, for example, with the perpetrator's detection and knowledge, for example, accompanied by an alarm, a siren, flashing lights, or another distress signal or indicator.

According to aspects of the invention, the marker 80 the perpetrator is tagged with is detectable and/or identifiable at a later time, for example, 10 minutes later, a week later, or even years later. As noted previously, in one aspect, the marker comprises a canine-detectable scent, for example, a scent that a dog, for example, a bloodhound, can detect and by which the perpetrator can be identified to authorities. In another aspect, the maker may be fluorescent and only be detectable when exposed to, for example, a black light. When the marker is an electronic device, for example, a sensor or detectable device on a microchip, electrical scanners can be used to detect the electronic device marker. Other markers and means of detecting markers will be apparent to those of skill in the art.

Aspects of the present invention can also be implemented with other conventional security systems or devices, for example, with closed-circuit television (CCTV) monitoring systems, to enhance the likelihood of apprehending the perpetrator.

Aspects of the present invention provide apparatus and methods for tagging a perpetrator, for example, a perpetrator robbing a convenience store, liquor store, bank, gas station, office, or other commercial establishment, or a home or residence. Of course, aspect of the invention may be used in any location, facility, or venue to "tag" individuals, articles, or merchandise, covertly or overtly. For example, at a public event, attendees can be tagged with a marker confirming payment of an entrance fee, allowing egress and ingress with confirmation of the presence of the marker. In another example, merchandise may be tagged with a marker to confirm that the merchandize has been paid for. Other applications of aspects of the invention will be apparent to those of skill in the art. As will be appreciated by those skilled in the art, features, characteristics, and/or advantages of the various aspects described herein, may be applied and/or extended to any embodiment (for example, applied and/or extended to any portion thereof).

Although several aspects of the present invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

The invention claimed is:

1. A method for tagging a perpetrator with a marker, the method comprising:

actuating a trigger positioned remotely of a marker delivery device associated with a door, thereby arming the marker delivery device;

sensing a presence of a perpetrator in a target area of the marker delivery device with a sensor; and when the presence of the perpetrator is detected by the sensor and when the marker delivery device is armed, contacting the perpetrator in the target area with a marker emitted by the armed marker delivery device.

2. The method as recited in claim 1, wherein the marker comprises one of a fluid marker and a solid marker.

3. The method as recited in claim 1, wherein the marker comprises a canine-detectable scent.

4. The apparatus of claim 1, wherein the trigger comprises a manual or foot-operated trigger.

5. The method as recited in claim 1, wherein actuating the trigger comprises actuating the trigger by noise.

6. The method as recited in claim 5, wherein the noise comprises a gunshot.

7. An apparatus for tagging a perpetrator, the apparatus comprising:

a marker delivery device;

a sensor adapted to sense the presence of the perpetrator in a target area of the marker delivery device; and a trigger configured to arm the marker delivery device, the trigger positioned remote from the marker delivery device;

wherein, when the marker delivery device is armed and when a perpetrator in the target area is detected by the sensor, a marker is emitted on the perpetrator in the target area by the armed marker delivery device.

8. The apparatus as recited in claim 7, wherein the marker delivery device comprises one of a fluorescent marker delivery device and a canine detectable-scent delivery device.

9. The apparatus as recited in claim 7, wherein the marker delivery device is positioned in a vicinity of a door.

10. The apparatus as recited in claim 7, wherein the marker delivery device is positioned in a door.

11. The apparatus as recited in claim 10, wherein the marker delivery device is positioned in a lower section of the door.

12. The apparatus as recited in claim 10, wherein the marker delivery device positioned in the door comprises a marker supply, a valve operatively connected to the marker supply, and a nozzle operatively connected to the valve and adapted to emit marker to the target area.

13. The apparatus as recited in claim 7, wherein the trigger is positioned in a building, and wherein the marker delivery device is positioned outside the building.

14. The apparatus as recited in claim 13, wherein the marker delivery device is positioned outside the building in one of a post, stanchion, and a housing.

15. The apparatus as recited in claim 7, wherein the sensor is positioned in a door.

16. The apparatus as recited in claim 15, wherein the sensor is positioned in a lower section of the door.

17. The apparatus as recited in claim 7, wherein the marker comprises one of a fluid marker and a solid marker.

18. The apparatus of claim 7, wherein the trigger comprises a trigger activated by noise.

19. The apparatus of claim 18, wherein the noise comprises a gunshot.

20. The apparatus as recited claim 7, wherein the sensor comprises one of an optical sensor and a motion sensor.

* * * * *